United States Patent [19]

Barnett

[11] Patent Number: 4,458,662

[45] Date of Patent: Jul. 10, 1984

[54] CATALYTIC STOVE

[75] Inventor: Stockton G. Barnett, Plattsburgh, N.Y.

[73] Assignee: Condar Co., Hiram, Ohio

[21] Appl. No.: 315,923

[22] Filed: Oct. 28, 1981

[51] Int. Cl.[3] ..... F24C 1/14; F23B 5/00

[52] U.S. Cl. ..... 126/77; 110/205; 110/214; 423/247

[58] Field of Search ..... 126/77, 112, 163 R, 126/163 A, 146, 121; 110/203, 205, 204, 214; 423/247; 422/180

[56] References Cited

U.S. PATENT DOCUMENTS

| | | | |
|---|---|---|---|
| 2,845,882 | 8/1958 | Bratton | 110/214 |
| 3,043,245 | 7/1962 | Hebert | 110/211 |
| 3,130,961 | 4/1964 | Verner | 263/6 |
| 3,785,778 | 1/1974 | Burstein et al. | 423/247 |
| 4,078,541 | 3/1978 | Roycraft | 126/99 R |
| 4,179,065 | 12/1979 | Zung | 126/121 |
| 4,212,854 | 7/1980 | Maki | 423/247 |
| 4,224,921 | 9/1980 | Petrescue | 126/121 |
| 4,254,756 | 3/1981 | Wells | 126/121 |
| 4,319,556 | 3/1982 | Schwartz | 110/203 |
| 4,330,503 | 5/1982 | Allaire | 110/203 |
| 4,363,785 | 12/1982 | Willson | 110/214 |

FOREIGN PATENT DOCUMENTS 55-155110 12/1980 Japan .

*Primary Examiner*—Daniel J. O'Connor
*Attorney, Agent, or Firm*—Fay & Sharpe

[57] ABSTRACT

A catalytic stove comprised of a housing having a fuel-burning chamber and an effluent chamber. The effluent chamber is separated from the fuel-burning chamber by a common wall. The wall is at the top of the fuel burning chamber and is inclined to form a cathedral or domed chamber ceiling. Air inlet ports are located in the fuel burning chamber and draft air is introduced to burning fuel at substantially the same rate from each port. The effluent from the fuel flows to a catalyst in the top of the fuel burning chamber. The effluent flows substantially directly from the fuel to the catalyst without undersirable eddying thereby preventing the effluent from cooling and condensing into creosotic droplets. The catalyst assists in burning an increased percentage of the flue gases. An air diffuser is provided contiguous to the catalyst and provides an air mix with the effluent from the burning fuel to further facilitate oxidation in the catalyst.

12 Claims, 7 Drawing Figures

CATALYTIC STOVE

BACKGROUND OF THE INVENTION

This invention pertains to the art of fuel-burning devices and, more particularly, to a fuel-burning device including an oxidation catalyst.

The invention is particularly applicable to woodburning stoves. The invention can be readily used in other fuel burning appliances in which an oxidation catalyst is employed, particularly in other solid fuel appliances.

Conventional woodburning stoves, fireboxes or fireplaces do not burn all the combustible substances of a conventional fuel such as wood. The smoke and gas effluent of a wood fire normally contains creosotes and substantial quantities of oxidizable substances such as combustible gases. Such gases can condense and become attached to a flue passageway during the emission of the effluent to the environment. Continued condensation and attachment may result in a particularly undesirable fire hazard in a flue or chimney, substantially hampering the efficiency of the burning device, and polluting the atmosphere.

In a wood burning operation, at a temperature of 250° F., oxidizable effluent gases are completely fogged (condensed droplets) while at 450° F. the effluent is 70–80% gas with the remainder comprising condensed droplets. Since the condensed droplets will not oxidize in a catalyst, an effluent reheating method or element has been necessary to raise the temperature of the effluent such that the condensed droplets would again become gaseous. Alternatively, the effluent was kept extremely hot, often by overfiring the stove.

Oxidation catalysts have been employed in combination with other fuel burning or incinerator devices for combusting smoke, creosotic flue gases and other objectionable components in the effluent. In order to promote such combustion, some prior art devices have employed various methods to reheat creosotic gases which have condensed to droplets during travel from the burning fuel to the catalyst.

In other catalytic woodburning stoves found in the prior art, it has been necessary to operate the stove at a temperature higher than was desirable for residential operation, in order to operate the catalyst device without reheating the effluent. Such stoves would often consume six or more pounds of wood per hour in order to prevent some of the effluent from cooling to a temperature near 250° F. and condensing as it passed from the woodburning flame to the catalyst. Substantial eddying of effluent along the stove top and side walls would cause the effluent to cool. To prevent such cooling an undesirably high temperature had to be maintained so that the effluent would contain predominantly gases as opposed to condensed creosote droplets.

The present invention contemplates a new and improved device which overcomes all of the above referred to problems. It provides a new catalytic stove which is simple in design, economical to manufacture and adaptable for use in residential environment. It is easy to install, and it operates at a temperature which is not undesirably hot, unsafe, or wasteful of energy. The present invention provides improved catalytic oxidation of effluent from a burning fuel.

The present invention combines a unique catalytic dome with a uniquely controlled and directed air flow. It typically lowers fuel useage from an objectionable six or more pounds per hour (a burning rate higher than normally encountered in homes) to a heretofore unobtainable two pounds per hour (a rate commonly desired in homes). This economy greatly expands the operating range of a catalytic woodburning stove.

BRIEF SUMMARY OF THE INVENTION

The present invention is a fuel-burning apparatus or stove comprised of a housing containing a fuel-burning chamber. The stove has means in the chamber for supporting the fuel which is to be burned. Access means are provided so that fuel may be easily placed in the stove. The stove also has a flue port which allows the products of combustion to leave the housing. The stove contains a fuel-burning chamber top wall which has a generally centrally-disposed port through which effluent may move to the flue port. A catalyst device is located contiguous to the port in the chamber top for catalytic burning of effluent flue gases. Air inlet openings into the fuel-burning chamber allow an equal velocity draft air to enter both sides of the stove.

The air inlet ports are disposed contiguous to the fuel substance. They are in communication with an air passageway which has a selectively controllable air opening to the environment of the stove. The selectively controllable air opening includes a thermostatically controllable air opening closure device.

The stove is designed so that effluent emitted by burning fuel remains in a substantially gaseous state in the fuel burning chamber and then is eliminated by the catalyst before the effluent leaves the housing.

The top wall port of the fuel chamber is located above an intersection of the top wall and the side walls of the fuel chamber. The top wall of the fuel chamber is domed.

In accordance with a more limited aspect of the present invention, the top wall of the fuel-burning chamber includes a selectively operable baffle and baffle opening disposed for communication with the flue port.

In accordance with yet another aspect of the present invention, an air diffuser is disposed contiguous to the catalyst device and includes an air passageway communicating the air diffuser with an air inlet port. The diffuser is located between the catalyst and the means for supporting the fuel and the diffuser enhances oxidation of effluent gases.

One benefit obtained by use of the present invention is that oxidizable elements are substantially eliminated from the stove effluent.

Another benefit is that overfiring or the use of secondary heating methods are unnecessary in order to provide an effluent which is substantially gas as opposed to condensed droplets.

Yet another benefit is that catalytic action will take place at stove outputs low enough to be comfortable to room occupants. In addition to better comfort, significant energy savings will develop from elimination of overfiring.

Other benefits and advantages for the new catalytic stove will become apparent to those skilled in the art upon a reading and understanding of this specification.

BRIEF DESCRIPTION OF THE DRAWINGS

The preferred embodiment of the new catalytic stove is described in detail in this specification and illustrated in the accompanying drawings.

DETAILED DESCRIPTION OF THE INVENTION

Figure 1:
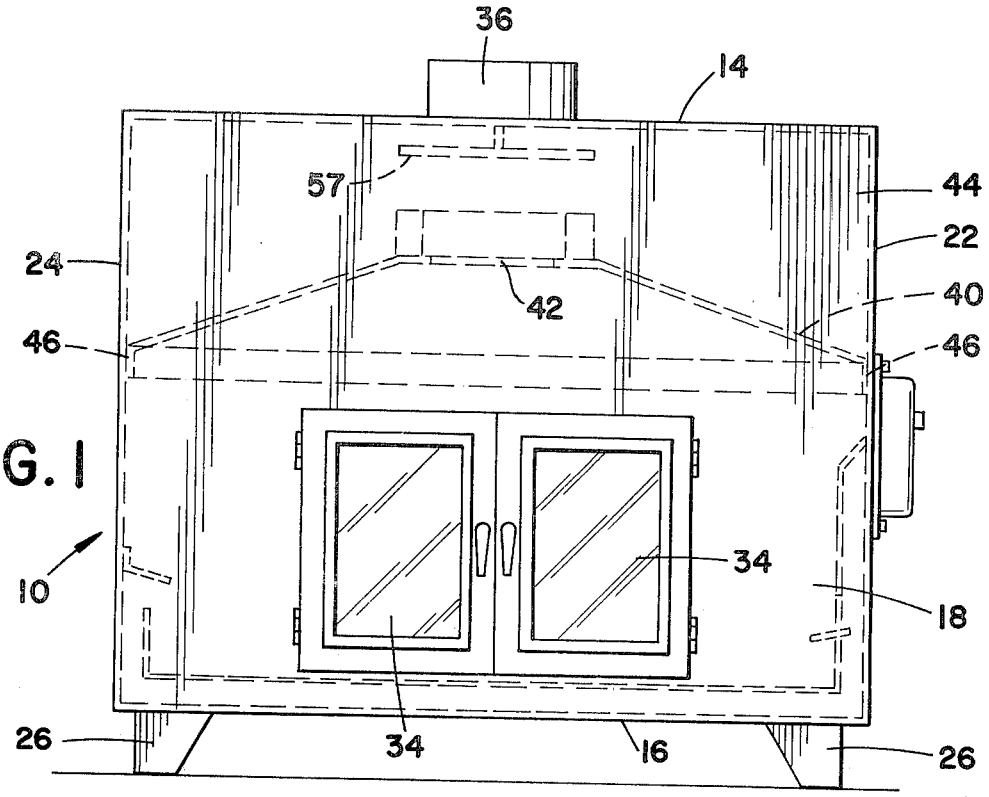
FIG. 1 is an elevated front end view of a catalytic stove formed in accordance with the present invention and is taken along line 1—1 of FIG. 3.

Referring now to the drawings wherein the showings are for purposes of illustrating the preferred embodiment of the invention only and not for purposes of limiting same, the figures show a fuel-burning apparatus comprising a catalytic stove 10 preferably employed for heating a personal residence.

Figure 2:
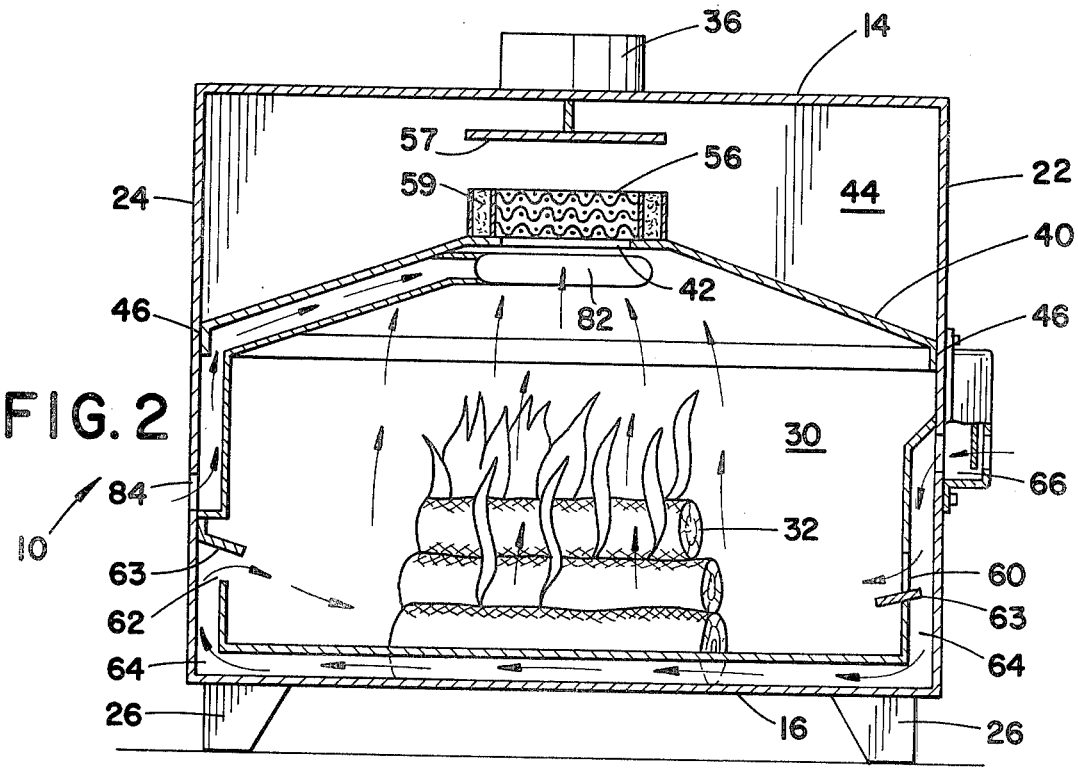
FIG. 2 is a cross-sectional view of the stove of FIG. 1 taken along line 2—2 of FIG. 4.
Figure 3:
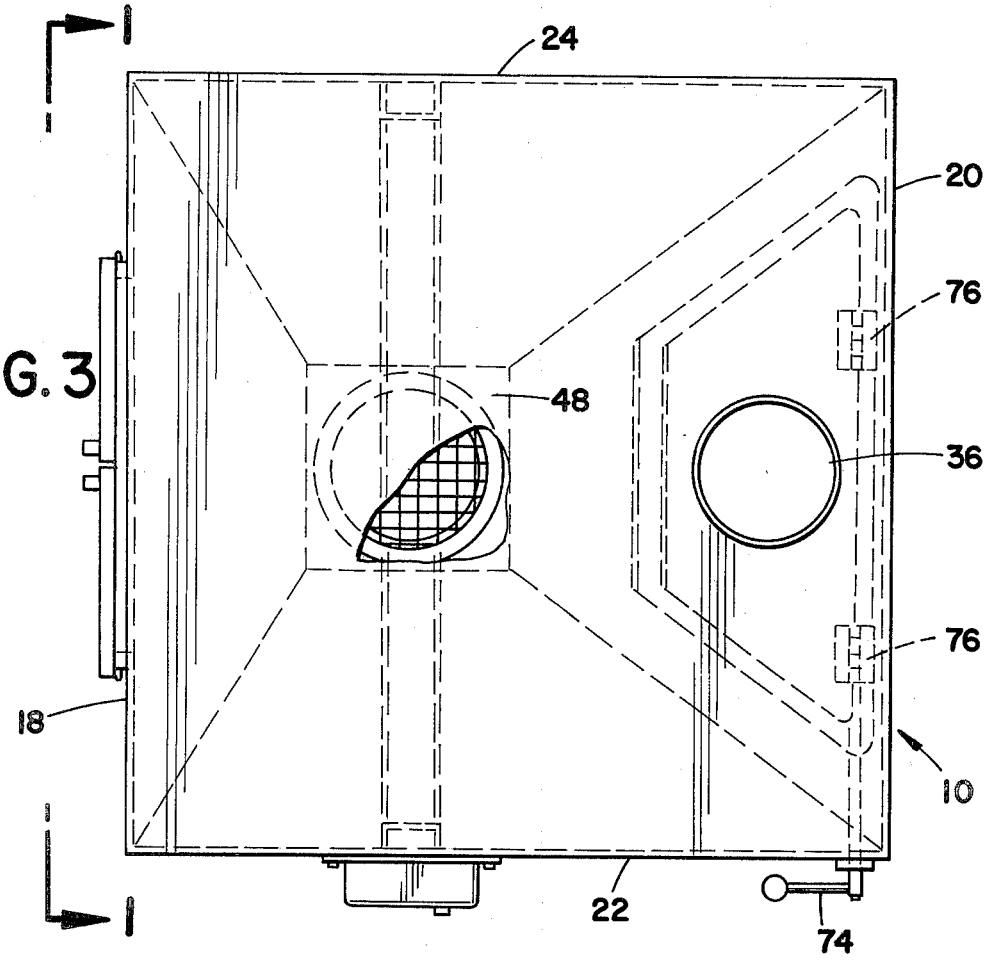
FIG. 3 is a top plan view, in partial section, of the catalytic stove of FIG. 1.

More specifically, and with reference to FIGS. 1 and 2, stove 10 includes a housing 12 having a generally box-like overall configuration. The housing 12 includes a top wall 14, a bottom wall 16, a front side wall 18, a back side wall 20, a first end side wall 22 and a second end side wall 24. The stove 10 may be spaced apart from a support surface with support legs 26. A fuel-burning chamber 30 is included in housing 10 for receiving fuel such as wood logs 32. Conventional means are provided for supporting the fuel substance for burning in the chamber 30 and may comprise a bottom wall 16 of housing 10 or a conventional support grate (not shown). Access to the fuel-burning chamber 30 is provided through conventional doors 34 in front side wall 18. The doors may swing open or close and lock. A flue port 36 is provided in housing top wall 14 to provide for egress of effluent from the housing. Disposed intermediate of the top wall 14 and bottom wall 16 is a fuel-burning chamber top wall 40 depending from side walls 18, 20, 22 and 24. The top wall of the fuel chamber has a generally centrally-disposed port 42 for effluent communication to flue port 36 through an effluent chamber 44. Port 42 is preferably located above the intersection joints 46 of the top wall of the fuel-burning chamber and the side walls such that the top wall 40 is inclined to comprise a cathedral or domed chamber type ceiling for fuel-burning chamber 30. The fuel-burning chamber top wall 40 preferably comprises four trapezoidally configured sheets joined to a fuel-burning chamber top wall port plate 48 which includes the chamber port 42 (FIG. 3).

A catalyst device 56 is located contiguous to the fuel-burning chamber top wall port 42 for catalytic burning of effluent flue gases. The catalyst device 56 preferably comprises a honeycomb configuration constructed of platinum coated or palladium coated honeycomb or screen elements.

Suspended just above catalyst 56 is a catalyst cap member 57. This catalyst cap can be a plate or it can be formed of insulation such as fire brick or other suitable insulating material. The plate acts to raise the temperature of the top part of the stove, i.e., effluent chamber 44, thus enhancing the combustion efficiency of the catalyst. The plate also acts to protect the top of the stove itself from excess heat coming from the catalyst. The net effect of the plate acting in concert with the insulation 59 around the catalyst is to create what substantially is a secondary combustion chamber.

Air inlet ports 60 and 62 to the fuel-burning chamber 30 are preferably provided contiguous to the fuel substance. Air inlet ports 60 and 62 are communicable with an air passageway 64 extending along at least the bottom wall 16 and having a selectively controllable air opening 66 exposed to the environment of stove 10. Preferably the selectively controllable air opening 66 includes a thermostatically controllable air opening closure device 68 for controlling the amount of air which may be drawn into chamber 30 through ports 60 and 62 and opening 66. Ports 60 and 62 are positioned such that the air drawn into chamber 30 through ports 60 and 62 is introduced into the chamber at the same velocity. The ports are positioned substantially opposite each other and are provided with suitable deflectors 63.

It should be understood that a plurality of opposed inlet ports may be used but they should be positioned and sized so that substantially the same amount of air from each port is directed toward the approximate center of the fuel being burned. In this way, the air from each of the ports will have a tendency to collide and turn upward toward the catalyst. It is not a departure from the spirit of this invention if several smaller ports on one side of the fuel are opposed to a larger port on the other side of the fuel as long as the net effect is to direct substantially equal and opposite air flows to the center of the fire.

Figure 4:
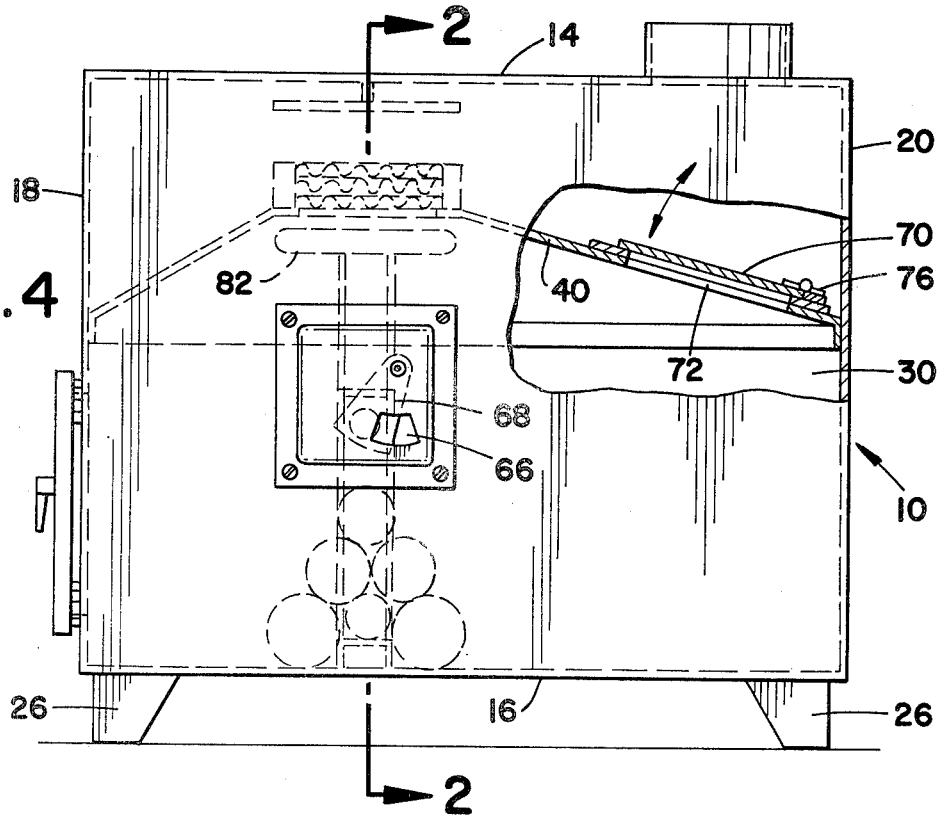
FIG. 4 is a side end view, in partial section, of the catalytic stove of FIG. 1.

With particular reference to FIGS. 3 and 4, a selectively operable baffle 70 and baffle opening 72 are included in the fuel-burning chamber top wall 40 to provide an alternate egress port for effluent from the fuel-burning chamber 30. Preferably, baffle 70 comprises a swinging door which is operable with an operating handle 74 for swinging the baffle 70 about its hinges 76. In operation, baffle 70 is opened during igniting of the fuel supply 32 and initial heatup of the stove 10. It is normally kept open until the catalyst device 56 becomes operable to oxidize effluent gases. The baffle is preferably also opened before the stove door is opened.

For purposes of providing a separate air inflow near the catalyst device 56 to facilitate oxidation of effluent gases in the catalyst device 56, an air diffuser 82 is located contiguous to the catalyst device 56 intermediate of the device and the bottom wall 16 of housing 12. A diffuser inlet port 84 (FIG. 2) provides air to the diffuser through a diffuser air passageway 86, which preferably extends along the second end side wall 24 and the fuel-burning chamber top wall 40 to the diffuser 82.

Figure 5:
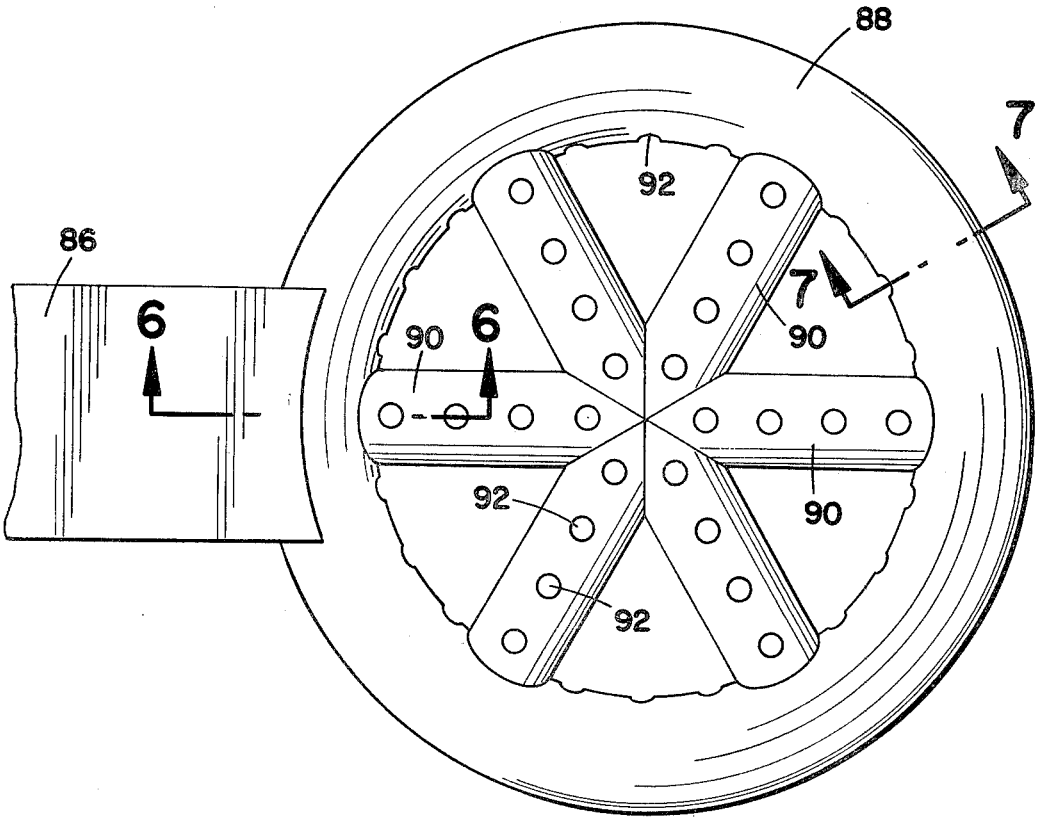
FIG. 5 is an enlarged plan view of a diffuser employed with the present invention.
Figure 6:
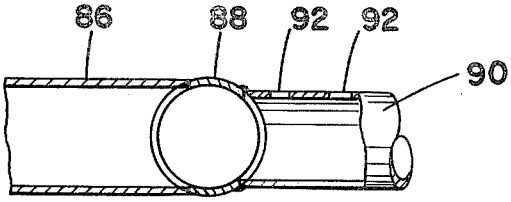
FIG. 6 is a cross-sectional view taken along line 6—6 of FIG. 5.
Figure 7:
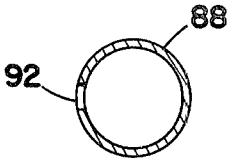
FIG. 7 is a cross-sectional view taken along line 7—7 of FIG. 5.

With particular reference to FIGS. 5, 6 and 7, it is seen that the diffuser comprises an outer ring 88 and a plurality of radially extending inner tubes 90. Both the ring 88 and the tubes 90 include a plurality of air bores 92 through which air may pass for mixture with the effluent of the fuel-burning chamber 30 for better oxidation in the catalyst device 56. The air bores 92 of the inner tubes 90 are directed towards the catalyst 56 and the air bores 92 of the outer ring 88 are directed radially inward to facilitate better mixing with the rising effluent.

It should be realized that the air diffuser may take a number of different forms. For example, it could be comprised simply of a square or round plate containing a number of holes. The plate is placed at the outlet end of the secondary air supply. If the diffuser is in the form of a plate, it may be placed either above or below the secondary air tube. In any event, the plate or diffuser does several things: (a) it creates turbulence and hence mixing of the flue gases with secondary air; (b) it becomes hot, in part from radiation from the catalyst, and this heat, in turn, greatly assists in additionally heating the fuel gas and secondary air mixture before they enter the catalyst. Typically, fire box gases at 400°–450° F. are raised to about 850° F. The plate also tends to block about one-half of the catalyst's radiation from reaching the wood in the fire box. This substantially prevents the wood from excessively burning anaerobically.

OPERATION

With particular attention to FIGS. 2 and 4, the improved operating characteristics of the new catalytic stove will be specifically discussed.

Cooling of effluent to form condensed creosotic droplets in conventional stove designs is at least partly caused by eddying of effluent from a burning fuel within the fuel-burning chamber prior to egress of the effluent from the stove. Upon cooling, the effluent becomes a fog of condensed creosotic droplets which is an obnoxious waste product to the environment and causes a dangerous creosote buildup in the flue pipe. In order for the catalyst device in prior art stove designs to be operable, it was necessary to burn the fuel at an excessively high rate to raise the temperature such that even though eddying was substantial, the effluent would not cool to a level where it would substantially be comprised of condensed creosotic droplets. Often this required the use of six or more pounds of wood per hour.

The present invention provides a stove design which substantially reduces eddying of effluent and thereby substantially reduces cooling of the effluent between the time it is emitted from the burning fuel and the time it reaches the catalyst. The catalyst operates at a fuel use rate of about two pounds of wood per hour. This extremely efficient operation is achieved by combining an appropriately shaped catalytic dome with properly directed air inlet ports which supply a substantially uniform air flow into the fuel.

Air inlet ports 60 and 62 in fuel-burning chamber 30 are disposed such that air jets will be drawn in through the ports 60 and 62 towards the burning fuel in an equal balance at substantially the same velocity for participation in the oxidation of the fuel. Effluent from the burning fuel is channeled along the side walls 18, 20, 22 and 24 and the top wall 40 to the catalyst device 56 in a manner which substantially avoids eddying at the fuel-burning chamber side walls. Eddying is avoided because of the smooth and generally straightforward flow along the side walls and because of the incline of the fuel-burning chamber top wall 40. Since eddying is minimized, cooling is minimized. The effluent is thus in a substantially gaseous state when it reaches the catalyst device 56, even when the fuel is burned at the relatively low burn rates which are desirable in personal residences.

In one embodiment of the invention, the air flow through air inlet ports 60 and 62 is selectively controllable at a single air opening 66 by selectively controlling the area of the opening 66 with an air opening control member 68. In the preferred embodiment of the invention, the air opening control member 68 is automatically controlled with a thermostat which senses the temperature of the stove fuel-burning chamber 30. The control automatically opens or closes the air opening 66 for regulating air flow thereby raising or lowering the temperature of the fuel-burning chamber 30.

After the effluent has reached the catalyst 56, and oxidizable gases in the effluent have been oxidized in the catalyst device, the effluent is directed to the flue port 36 through the effluent chamber 44 for egress from the stove 10.

In the preferred embodiment of the invention, the air diffuser 82 operates to mix secondary air drawn in through the diffuser air inlet port 84 with the effluent prior to the effluent's encounter with the catalyst device 56. This facilitates oxidation of the oxidizable flue gases in the catalyst device 56. It should be noted that this secondary air supply is pre-heated due to the location of the diffuser air passageway 86. Upon leaving the burning fuel 32, the effluent is normally substantially devoid of oxygen and the addition of air with the effluent provides the additional necessary oxygen for oxidation.

The invention has been described with reference to the preferred embodiment. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. A fuel-burning apparatus comprising:

a housing including a fuel-burning chamber;

means for supporting a fuel substance for burning in said chamber;

an access means for providing fuel to said means for supporting;

a flue port for egress of effluent flue gases from said housing;

a fuel-burning chamber top wall having a domed configuration with a generally centrally-disposed port through which said effluent may flow to the flue port;

a catalyst device disposed contiguous to the port in the top wall of the fuel-burning chamber for catalytic burning of said effluent flue gases; and, at least two opposed air inlet ports to said fuel-burning chamber which direct substantially equal amounts of air towards said fuel substance wherein effluent emitted from burning said fuel substance remains in a substantially gaseous state in said fuel-burning chamber due to the cooperation of said domed chamber top wall and said at least two air inlet ports which provide for a smooth flow path for said effluent flue gases and prevent eddying and hence cooling of said flue gases and wherein said effluent is substantially oxidized by said catalyst device before egress from said housing.

2. The fuel-burning apparatus as described in claim 1 wherein the fuel-burning chamber has side walls which intersect with the top wall and the port at the top of the chamber lies above this intersection.

3. The fuel-burning apparatus as described in claim 1 wherein said air inlet ports are disposed contiguous to said fuel substance.

4. The fuel-burning apparatus as described in claim 3 wherein said air inlet ports are communicable with an air passageway having a selectively-controllable air opening.

5. The fuel-burning apparatus as described in claim 4 wherein said selectively-controllable air opening includes a thermostatically controllable air opening closure device.

6. The fuel-burning apparatus as described in claim 1 wherein said chamber top wall is disposed intermediate of a top wall of said housing and said means for supporting a fuel substance.

7. The fuel-burning apparatus as described in claim 6 wherein said flue port is disposed in said housing top wall and an effluent chamber is disposed intermediate of said chamber top wall and said housing top wall for said effluent communication to said effluent port from said chamber top wall port.

8. The fuel-burning apparatus as described in claim 7 wherein the top wall of said fuel-burning chamber includes a selectively-operable baffle and baffle opening disposed for communication with said flue port.

9. The fuel-burning apparatus as described in claim 1 wherein said catalyst device comprises a platinum-coated screen.

10. The fuel-burning apparatus as described in claim 1 wherein said catalyst device comprises a palladium-coated honeycomb.

11. The fuel-burning apparatus as described in claim 1 further comprising an air diffuser which is disposed contiguous to said catalyst device and includes an air passageway communicating said air diffuser with a secondary air inlet port which provides auxiliary air to assist in the oxidization of said effluent by said catalyst device.

12. The fuel-burning apparatus as described in claim 11 wherein said diffuser is disposed intermediate of said catalyst device and said means for supporting a fuel substance whereby said diffuser becomes heated by said catalyst device and in turn heats said effluent flue gases, said diffuser also blocking a substantial portion of said catalyst device's radiation from reaching said fuel substance thereby preventing the anaerobic burning of said fuel substance.

* * * * *